US009903137B2

(12) United States Patent
Min et al.

(10) Patent No.: US 9,903,137 B2
(45) Date of Patent: Feb. 27, 2018

(54) ROTATING LOCK LATCH BOLT AND LOCKS HAVING THE ROTATING LOCK LATCH BOLTS

(71) Applicant: Hao Min, Jiangsu (CN)

(72) Inventors: Hao Min, Nanjing (CN); Jianping Sun, Nanjing (CN)

(73) Assignee: NANJING EASTHOUSE ELECTRICAL CO., LTD., Nanjing (CN)

( * ) Notice: Subject to any disclaimer, the term of this patent is extended or adjusted under 35 U.S.C. 154(b) by 0 days.

(21) Appl. No.: 15/022,202

(22) PCT Filed: Nov. 12, 2014

(86) PCT No.: PCT/CN2014/090931

§ 371 (c)(1),
(2) Date: Mar. 15, 2016

(87) PCT Pub. No.: WO2015/165247

PCT Pub. Date: Nov. 5, 2015

(65) Prior Publication Data

US 2017/0037656 A1 Feb. 9, 2017

Related U.S. Application Data

(63) Continuation of application No. PCT/CN2014/090931, filed on Nov. 12, 2014.

(30) Foreign Application Priority Data

Apr. 29, 2014 (CN) ..... 2014 1 0175836

(51) Int. Cl.
*E05B 17/20* (2006.01)
*E05B 65/00* (2006.01)
(Continued)

(52) U.S. Cl.
CPC ..... *E05B 17/2034* (2013.01); *E05B 47/0607* (2013.01); *E05B 49/00* (2013.01); *E05B 65/0075* (2013.01)

(58) Field of Classification Search
CPC .. E05B 17/2034; E05B 47/0607; E05B 49/00; E05B 65/0075
(Continued)

(56) References Cited

U.S. PATENT DOCUMENTS 4,837,975 A * 6/1989 Simpson ..... E05D 15/22 292/175
4,899,562 A * 2/1990 Gartner ..... G07C 9/0069 70/277
(Continued)

FOREIGN PATENT DOCUMENTS

CN 201071637 Y * 6/2008
WO WO-2015165247 A1 * 11/2015 ..... E05B 49/00

*Primary Examiner* — Suzanne L Barrett
(74) *Attorney, Agent, or Firm* — Ming Jiang; MM IP Services LLC

(57) ABSTRACT

The present disclosure relates to a rotating lock latch bolt and a lock having rotating lock latch bolt. In certain embodiments, rotating lock latch bolt may include a first cylindrical body and a second cylindrical body connected co-axially below the first cylindrical body. The lock may include a lock latch, a lock latch control mechanism, a rotating lock latch bolt, and a rotating lock latch bolt control mechanism. Lock latch control mechanism may be configured to drive lock latch to a first position to lock the lock, and to a second position to unlock the lock. The rotating lock latch bolt may be configured to bolt the lock latch to prevent the lock latch from moving when the lock latch is in the first position. The rotating lock latch bolt control mechanism may be configured to rotate the rotating lock latch bolt to bolt and release the lock latch.

17 Claims, 8 Drawing Sheets

(51) Int. Cl.
*E05B 47/06* (2006.01)
*E05B 49/00* (2006.01)

(58) Field of Classification Search
USPC ..... 70/279.1
See application file for complete search history.

(56) References Cited

U.S. PATENT DOCUMENTS

| | | | | |
|---|---|---|---|---|
| 5,134,870 | A * | 8/1992 | Uyeda | E05B 47/0002 70/277 |
| 5,142,890 | A * | 9/1992 | Uyeda | E05B 47/0002 70/229 |
| 6,209,932 | B1 * | 4/2001 | Jung | E05B 85/26 292/216 |
| 7,322,621 | B2 * | 1/2008 | Liao | E05B 47/0047 292/341.16 |
| 8,261,586 | B2 * | 9/2012 | Gartner | E05B 47/0002 292/201 |
| 8,833,814 | B2 * | 9/2014 | Chang | E05B 63/0056 292/251.5 |
| 2008/0303290 | A1 * | 12/2008 | Yuan | E05B 47/0012 292/195 |
| 2010/0116006 | A1 * | 5/2010 | Huang | E05B 47/0047 70/91 |
| 2010/0117383 | A1 * | 5/2010 | Mackle | E05B 47/0047 292/341.16 |
| 2010/0127518 | A1 * | 5/2010 | Huang | E05B 47/0047 292/341.16 |

* cited by examiner

ROTATING LOCK LATCH BOLT AND LOCKS HAVING THE ROTATING LOCK LATCH BOLTS

CROSS-REFERENCE TO RELATED APPLICATION

This application is a continuation of a PCT/CN2014/090931, filed with the State Intellectual Property Office of China on Nov. 12, 2014, entitled "Rotating Lock Latch Bolt and Locks Having the Rotating Lock Latch Bolts", by Jianping SUN, and Hao MIN, which claims priority of Chinese Patent Application No. 201410175836.5, filed on Apr. 29, 2014, entitled "Rotating Lock Latch Bolt and Locks Having the Rotating Lock Latch Bolts" by Jianping SUN, and Hao MIN, the disclosures of which are incorporated herein by reference in their entirety.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to the technical field of locks, and more particularly to a rotating lock latch bolt and locks having the rotating lock latch bolts.

BACKGROUND OF THE INVENTION

In order to prevent content in a safe from being unauthorized accessed, a lock is usually used. The locking and unlocking of the lock are controlled by a locking mechanism either electrically or mechanically. Currently, the locking mechanism includes at least a swinging lock latch or a sliding lock latch to keep a lock locked or unlocked. The strength and stability of the lock depend on the dimension and strength of the lock latch, the dimension and strength of the lock latch support, and travelling distance of the movement of the lock latch. When the lock latch and the lock latch support are not big enough, or not strong enough, and when travelling distance of the movement of the lock latch is not long enough, the locking mechanism may not have sufficient strength to prevent breakage of the lock. Certain design of the locks may be easily broken by exerting a moderate force on the lock latch and the locking mechanism may fail. Furthermore, certain locking mechanism may be easily unlocked by applying impacting force, especially along a direction of a linear motion trajectory of a key-drawn locking mechanism, the key-drawn locking mechanism may produce instant movement causing instant unlocking by moving out of the motion trajectory of the locking tab. It is desirable to have a mechanism to prevent the lock latch from moving.

Therefore, heretofore unaddressed needs exist in the art to address the aforementioned deficiencies and inadequacies.

SUMMARY OF THE INVENTION

In one aspect, the present invention relates to a rotating lock latch bolt. In certain embodiments, the rotating lock latch bolt may include: a first cylindrical body; and a second cylindrical body. The second cylindrical body may be positioned below the first cylindrical body. One half of a middle portion of the second cylindrical body is removed to define a recess portion. The first cylindrical body and the second cylindrical body may be connected co-axially and rotatable along the axes of the first cylindrical body and the second cylindrical body.

In certain embodiments, the first cylindrical body may include a lock latch bolt gear to receive rotating driving force from a rotating lock latch bolt control mechanism configured to rotate the rotating lock latch bolt. The rotating lock latch bolt control mechanism may include a lock latch bolt control gear configured to drive the lock latch bolt gear to rotate the rotating lock latch bolt to a first position to bolt a lock latch, and rotate the rotating lock latch bolt to a second position to release the lock latch.

In certain embodiments, the lock latch may be positioned in the recess portion. The rotating lock latch bolt may bolt the lock latch when the rotating lock latch bolt is in the first position. The rotating lock latch bolt may release the lock latch when the rotating lock latch bolt is in the second position.

In another aspect, the present invention relates to a lock. The lock may include a lock latch, a lock latch control mechanism, a rotating lock latch bolt, and a rotating lock latch bolt control mechanism. The lock latch control mechanism may be configured to drive the lock latch to a first position to lock the lock, and to a second position to unlock the lock. The rotating lock latch bolt may be configured to bolt the lock latch to prevent the lock latch from moving when the lock latch is in the first position. The rotating lock latch bolt control mechanism may be configured to rotate the rotating lock latch bolt to bolt and release the lock latch.

In certain embodiments, the lock latch control mechanism may include a manual lock latch control mechanism, an electrical lock latch control mechanism, and a mechanical lock latch control mechanism.

In certain embodiments, the lock latch may include a rotating lock latch, or a sliding lock latch. The rotating lock latch bolt control mechanism may include an electrical rotating lock latch bolt control mechanism, and a mechanical rotating lock latch bolt control mechanism.

In certain embodiments, the rotating lock latch bolt may include a first cylindrical body, and a second cylindrical body. The second cylindrical body may be positioned below the first cylindrical body. Substantially one half of a middle portion of the second cylindrical body is removed to define a recess portion. The first cylindrical body and the second cylindrical body may be connected co-axially and rotatable along the axes of the first cylindrical body and the second cylindrical body.

In certain embodiments, the first cylindrical body may include a lock latch bolt gear to receive rotating driving force from the rotating lock latch bolt control mechanism. The rotating lock latch bolt control mechanism may be configured to rotate the rotating lock latch bolt. The rotating lock latch bolt control mechanism may include a lock latch bolt control gear for driving the lock latch bolt gear to rotate the rotating lock latch bolt to a first position to bolt the lock latch, and rotate the rotating lock latch bolt to a second position to release the lock latch.

In certain embodiments, the lock latch may be disposed in the recess portion of the rotating lock latch bolt. The lock latch control mechanism is configured to control the movement of the lock latch. The lock is locked when the lock latch control mechanism drives the lock latch to the first position, and the rotating lock latch bolt control mechanism drives the rotating lock latch bolt to the first position. The lock is unlocked when the rotating lock latch bolt control mechanism drives the rotating lock latch bolt to the second position, and the lock latch control mechanism drives the lock latch to the second position.

In yet another aspect, the present invention relates to a method for operating a lock. In certain embodiments, the method may include: receiving a passcode for the lock from a user at an electronic keypad, comparing the received passcode to one or more predetermined passcodes stored in the lock to determine whether the user is an authorized user, terminating when the user is not an authorized user, or performing following operations when the user is an authorized user. When the lock is in a locked position, the method may include: instructing a rotating lock latch bolt control mechanism to rotate a rotating lock latch bolt to an unlocked position to release a lock latch, displaying a message on a screen indicating that the lock may be unlocked, and unlocking the lock by moving the lock latch to an unlocked position using a lock latch control mechanism. When the lock is in an unlocked position, the method may include locking the lock by moving the lock latch to a locked position using the lock latch control mechanism, instructing the rotating lock latch bolt control mechanism to rotate the rotating lock latch bolt to a locked position to bolt the lock latch, and displaying a message on the screen indicating that the lock is locked.

In certain embodiments, the rotating lock latch bolt control mechanism may include an electrical rotating lock latch bolt control mechanism, and a mechanical rotating lock latch bolt control mechanism.

In certain embodiments, the lock latch may include a rotating lock latch, or a sliding lock latch.

In certain embodiments, the lock latch control mechanism may include a manual lock latch control mechanism, an electrical lock latch control mechanism, and a mechanical lock latch control mechanism.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention.

DETAILED DESCRIPTION OF THE INVENTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

As used herein, the terms "comprising," "including," "having," "containing," "involving," and the like are to be understood to be open-ended, i.e., to mean including but not limited to.

Prior to a detailed description of the present invention, the following definitions are provided as an aid to understanding the subject matter and terminology of aspects of the present invention, and not necessarily limiting of the present invention, which are expressed in the claims. Whether or not a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. A capitalized term within the glossary usually indicates that the capitalized term has a separate definition within the glossary. However, the capitalization or lack thereof within the remainder of this document is not intended to be necessarily limiting unless the context clearly indicates that such limitation is intended.

The description will be made as to the embodiments of the present invention in conjunction with the accompanying drawings in FIGS. 1-7.

Figure 1:
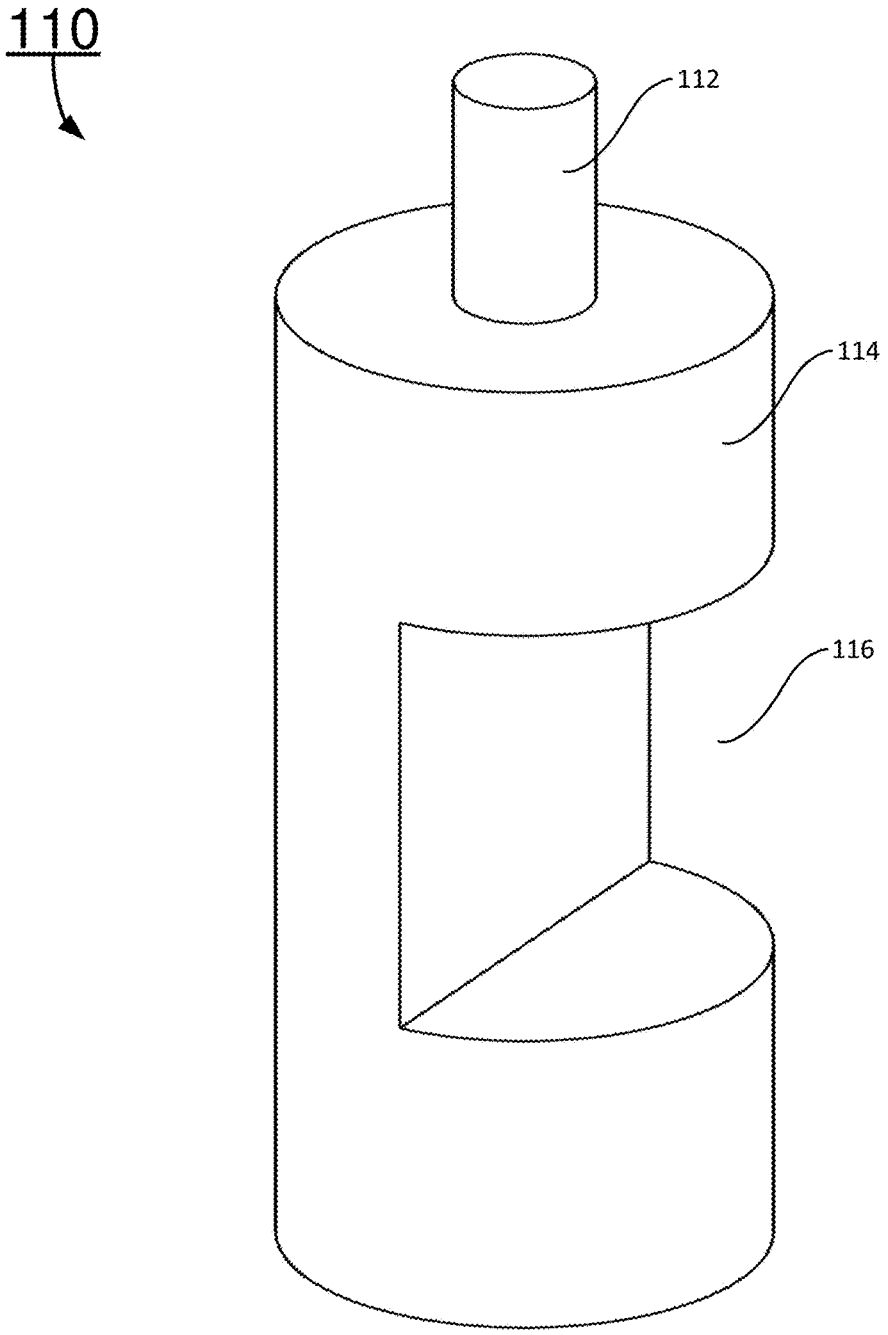
FIG. 1 is a perspective view of a rotating lock latch bolt according to certain embodiments of the present invention.

In accordance with the purposes of this invention, as embodied and broadly described herein, this invention, in one aspect, relates to a rotating lock latch bolt 110 for a lock as shown in FIG. 1. In certain embodiments, the rotating lock latch bolt 110 may include: a first cylindrical body 112; and a second cylindrical body 114. The second cylindrical body 114 may be positioned below the first cylindrical body 112. One half of a middle portion of the second cylindrical body 114 may be removed to define a recess portion 116 of the rotating lock latch bolt 110. The first cylindrical body 112 and the second cylindrical body 114 may be connected co-axially and rotatable along the axes of the first cylindrical body 112 and the second cylindrical body 114.

Figure 2:
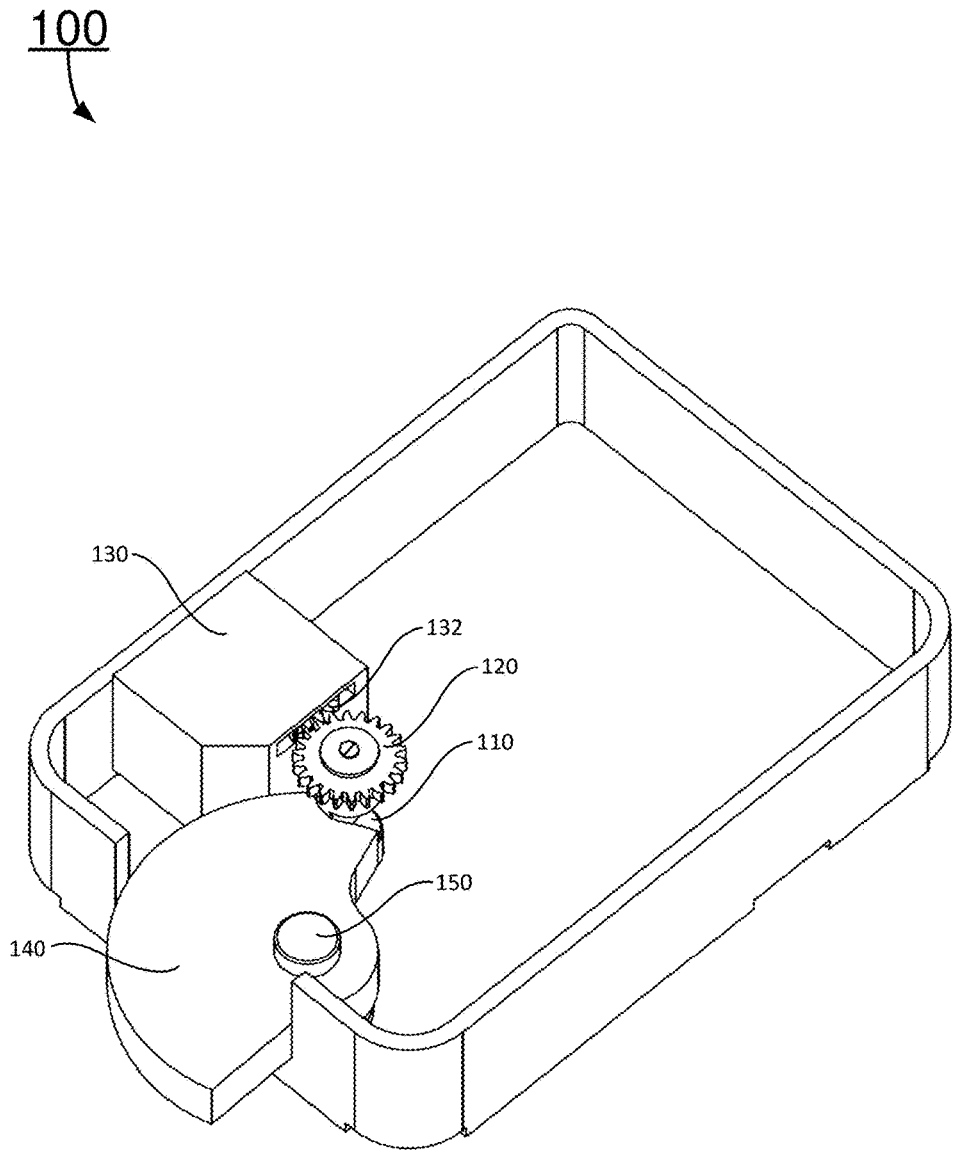
FIG. 2 is a perspective view of a locking mechanism having a swinging lock latch according to one embodiment of the present invention.
Figure 5:
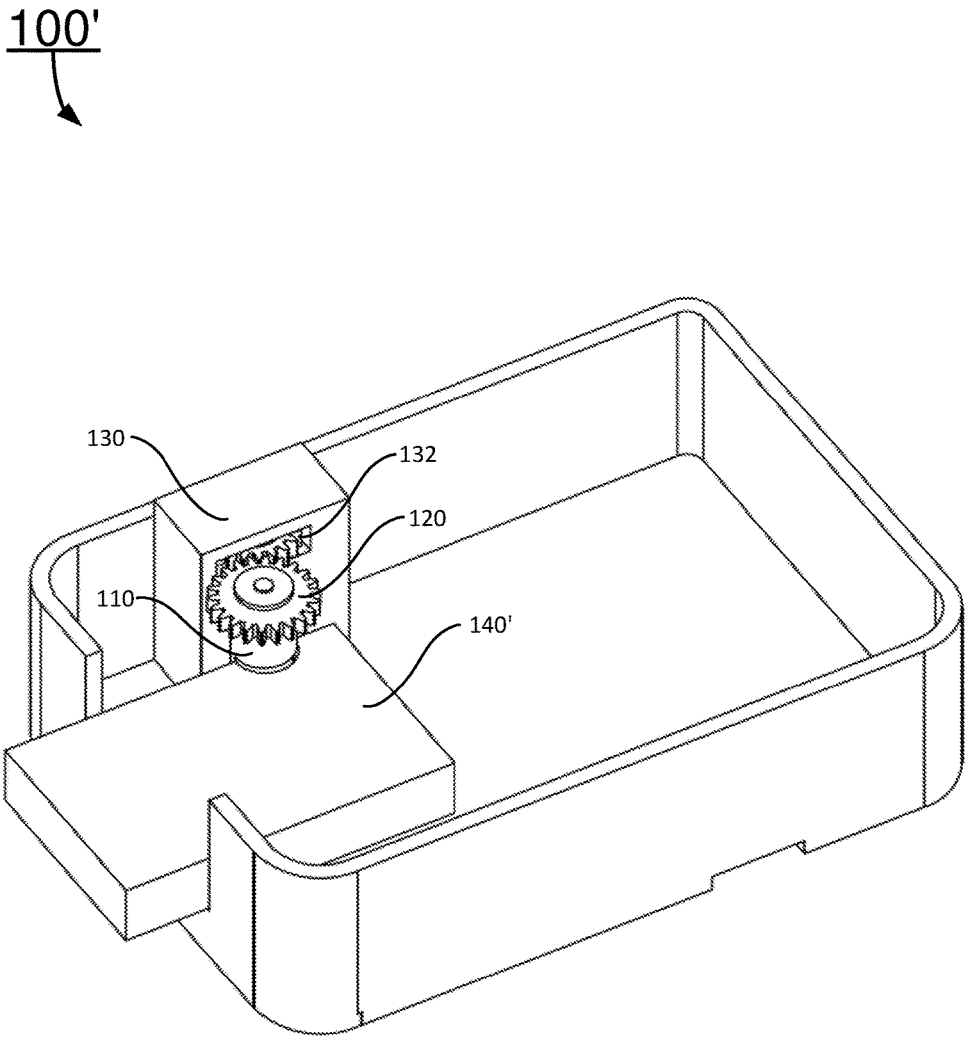
FIG. 5 is a perspective view of a locking mechanism having a sliding lock latch according to another embodiment of the present invention.

A locking mechanism having a rotating lock latch 140 is shown in FIG. 2, or a locking mechanism having a sliding lock latch 140 is shown in FIG. 5, respectively, according certain exemplary embodiments of the present invention. The first cylindrical body 112 may include a lock latch bolt gear 120 to receive rotating driving force from a rotating lock latch bolt control mechanism 130 configured to rotate the rotating lock latch bolt 110. The rotating lock latch bolt control mechanism 130 may include a lock latch bolt control gear 132 configured to drive the lock latch bolt gear 120 to rotate the rotating lock latch bolt 110 to a first position to bolt the rotating lock latch 140 as shown in FIG. 2, or the sliding lock latch 140' as shown in FIG. 5, and rotate the rotating lock latch bolt 110 to a second position to release the rotating lock latch 140, or the sliding lock latch 140'.

In another aspect, the present invention relates to a lock 100. The lock 100 may include, among other things, a lock latch 140, a lock latch control mechanism 150, a rotating lock latch bolt 110, and a rotating lock latch bolt control mechanism 130. The lock latch control mechanism 150 may be configured to drive the lock latch 140 to a first position to lock the lock 100, and to a second position to unlock the lock 100. The rotating lock latch bolt 110 may be configured to bolt the lock latch 140 to prevent the lock latch 140 from moving when the lock latch 140 is in the first position. The rotating lock latch bolt control mechanism 130 may be configured to rotate the rotating lock latch bolt 110 to bolt and release the lock latch 140.

In certain embodiments, the lock latch control mechanism 150 may include a manual lock latch control mechanism, an electrical lock latch control mechanism, and a mechanical lock latch control mechanism. The manual lock latch control mechanism and the mechanical lock latch control mechanism may be used in deadbolt locks, or key operated locks. The electrical lock latch control mechanism and mechanical lock latch control mechanism may be used in safe locks, or home automation applications.

Figure 3:
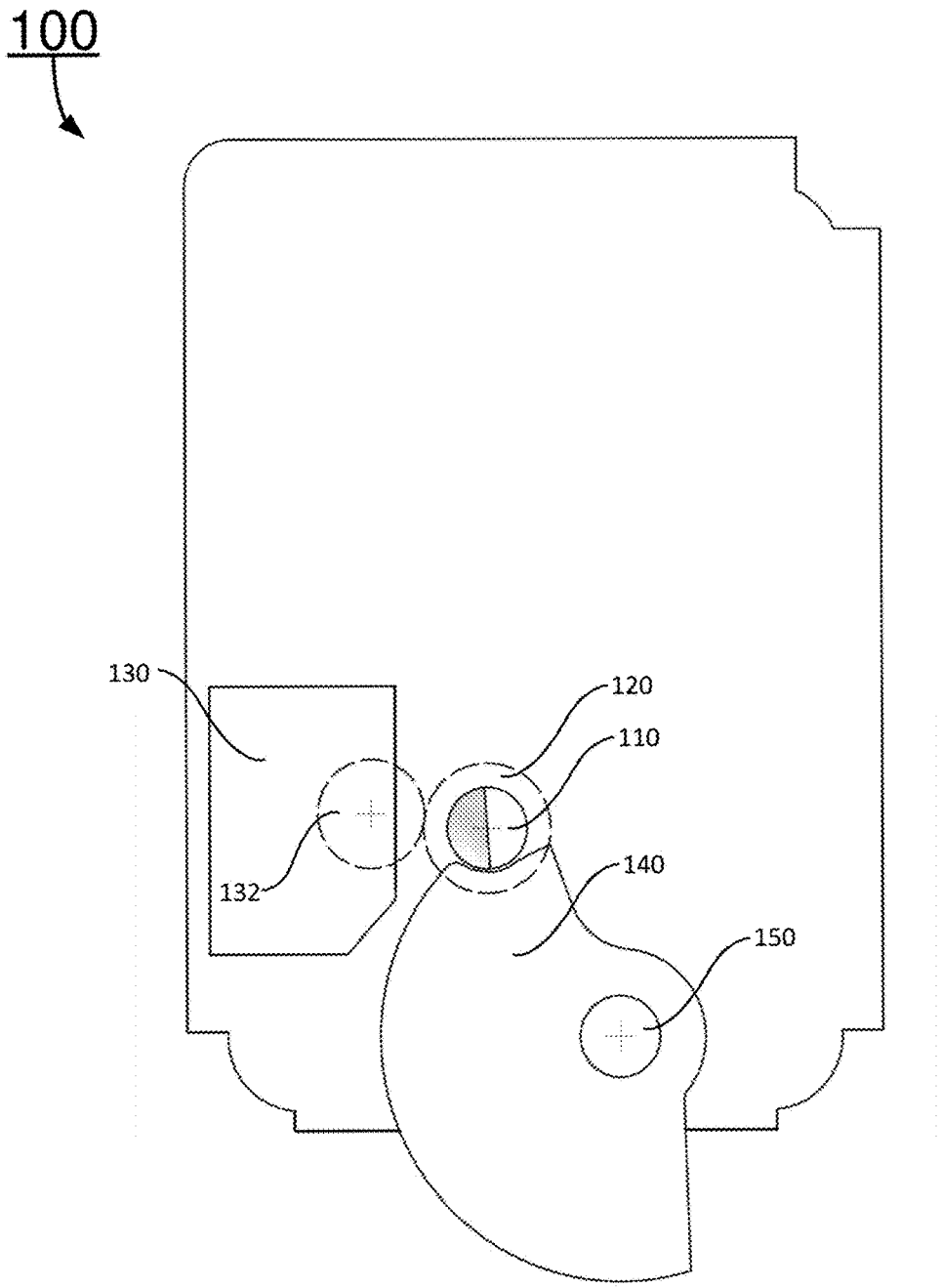
FIG. 3 is a top view of the locking mechanism as shown in FIG. 2 while the locking mechanism is in a locked position according to certain embodiments of the present invention.
Figure 4:
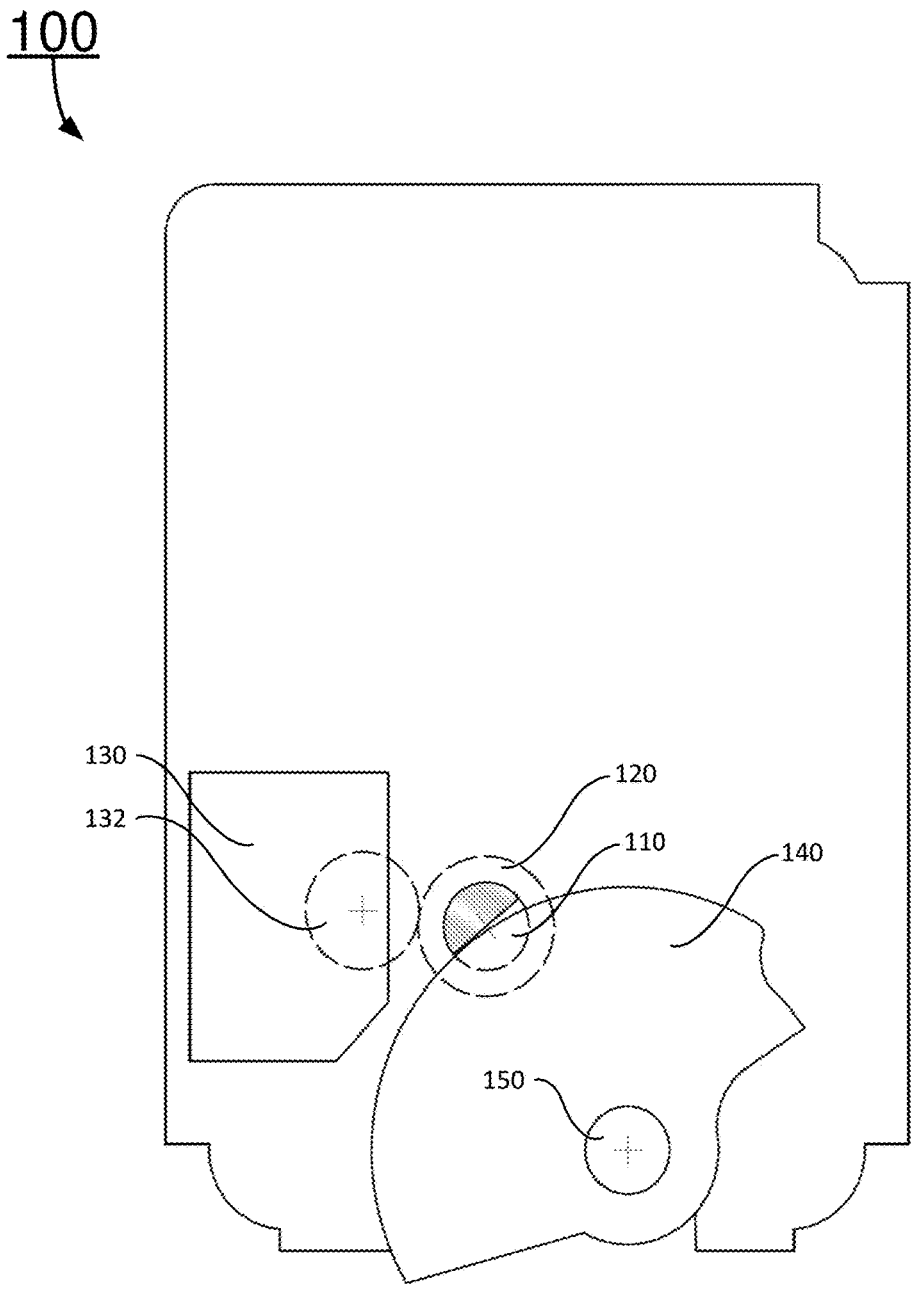
FIG. 4 is a top view of the locking mechanism as shown in FIG. 2 while the locking mechanism is in an unlocked position according to certain embodiments of the present invention.
Figure 6:
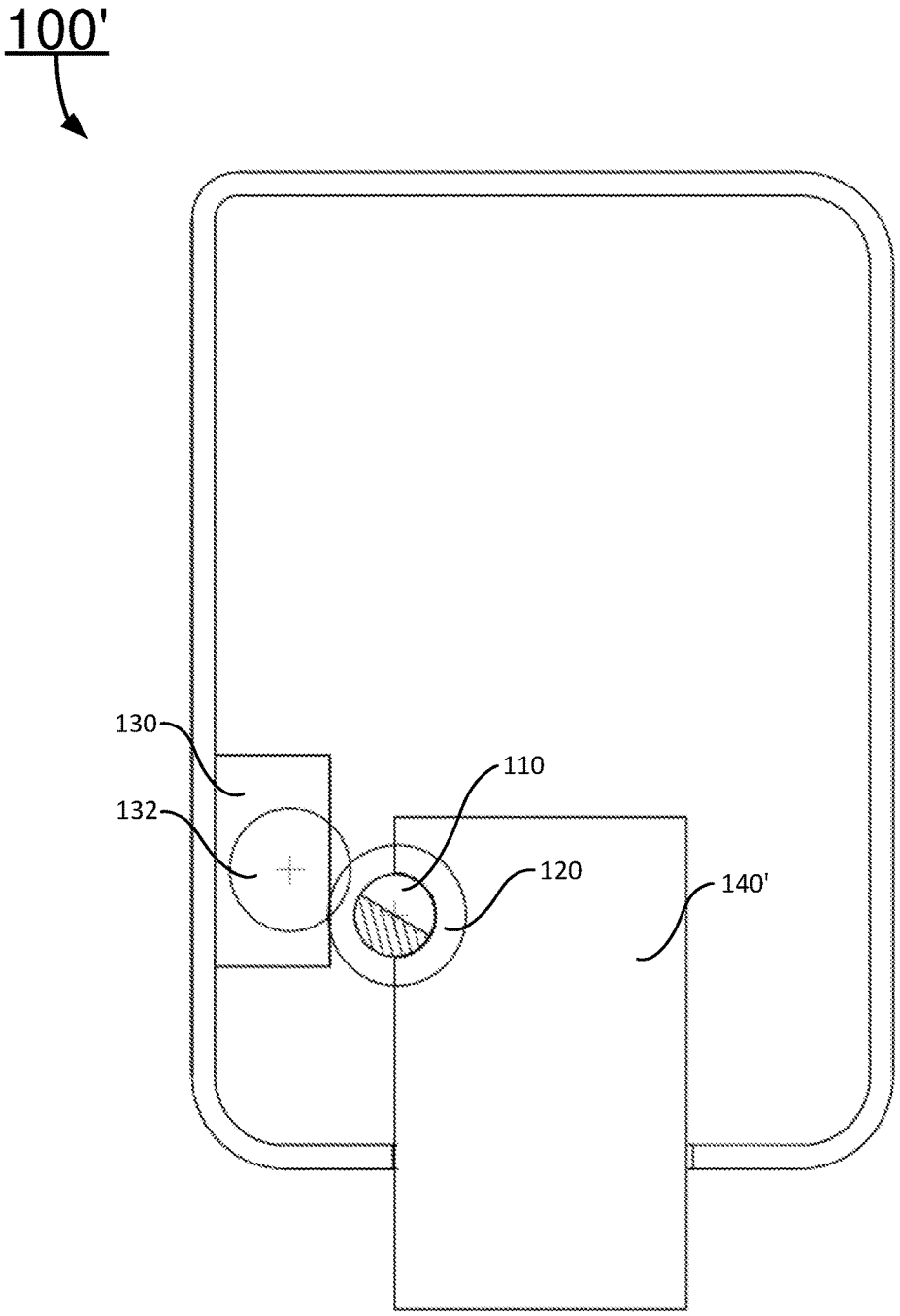
FIG. 6 is a top view of the locking mechanism as shown in FIG. 5 while the locking mechanism is in a locked position according to certain embodiments of the present invention.
Figure 7:
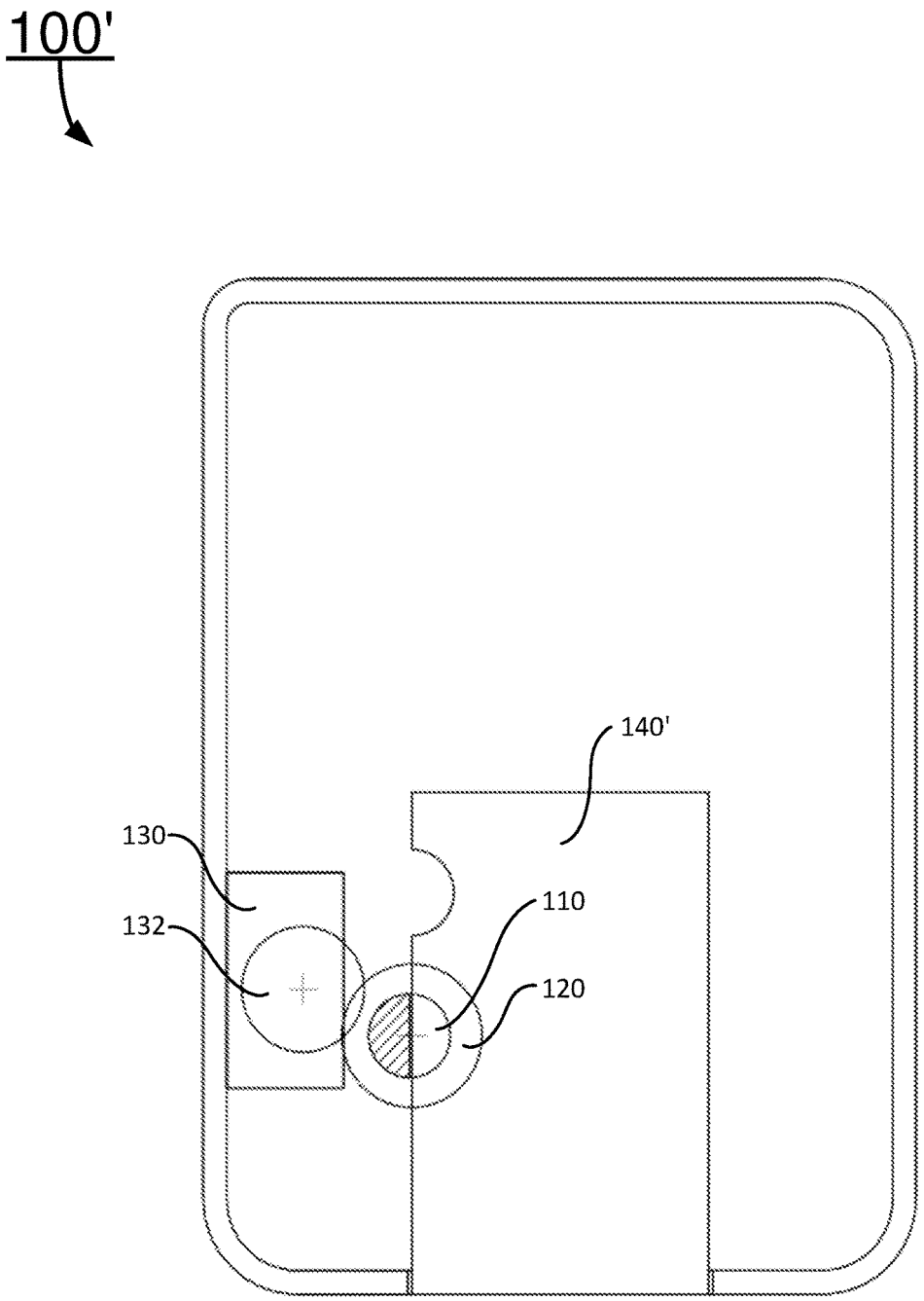
FIG. 7 is a top view of the locking mechanism as shown in FIG. 5 while the locking mechanism is in an unlocked position according to certain embodiments of the present invention.

In certain embodiments, the lock latch 140 may include a rotating lock latch 140 as shown in FIG. 2, FIG. 3, and FIG. 4, or a sliding lock latch as shown in FIG. 5, FIG. 6, and FIG. 7. The rotating lock latch bolt control mechanism 130 may include an electrical rotating lock latch bolt control mechanism, and a mechanical rotating lock latch bolt control mechanism.

In certain embodiments, the rotating lock latch bolt 110 may include a first cylindrical body 112, and a second cylindrical body 114 as shown in detail in FIG. 1. The second cylindrical body 114 may be positioned below the first cylindrical body 112. Substantially one half of a middle portion of the second cylindrical body 114 is removed to define a recess portion 116. The first cylindrical body 112 and the second cylindrical body 114 may be connected co-axially and rotatable along the axes of the first cylindrical body 112 and the second cylindrical body 114.

Referring to back to FIG. 2, in certain embodiments, the first cylindrical body 112 may include a lock latch bolt gear 120 to receive rotating driving force from the rotating lock latch bolt control mechanism 130. The rotating lock latch bolt control mechanism 130 may be configured to rotate the rotating lock latch bolt 110. The rotating lock latch bolt control mechanism 130 may include a lock latch bolt control gear 132 for driving the lock latch bolt gear 120 to rotate the rotating lock latch bolt 110 to a first position to bolt the lock latch 140, and rotate the rotating lock latch bolt 110 to a second position to release the lock latch 140.

Referring now to FIG. 3, a top view of the locking mechanism as shown in FIG. 2 while the locking mechanism is in a locked position is shown according to certain embodiments of the present invention. The swinging lock latch 140 may be positioned in the recess portion 116. When the swinging lock latch 140 is in the first position (the lock 100 is locked), the lock latch control mechanism 150 may rotate the rotating lock latch bolt 110 to the first position with certain angle, as shown in FIG. 3, to bolt swinging lock latch 140 to prevent the swinging lock latch 140 from moving away from the locked position.

Referring now to FIG. 4, a top view of the locking mechanism as shown in FIG. 2 while the locking mechanism is in an unlocked position is shown according to certain embodiments of the present invention. The swinging lock latch 140 may be positioned in the recess portion 116. When the rotating lock latch bolt 110 is rotated to the second position with certain angle, as shown in FIG. 4, the lock latch control mechanism 150 may rotate the swinging lock latch 140 to unlock the lock 100.

Referring to back to FIG. 5, in certain embodiments, the first cylindrical body 112 may include a lock latch bolt gear 120 to receive rotating driving force from the rotating lock latch bolt control mechanism 130. The rotating lock latch bolt control mechanism 130 may be configured to rotate the rotating lock latch bolt 110. The rotating lock latch bolt control mechanism 130 may include a lock latch bolt control gear 132 for driving the lock latch bolt gear 120 to rotate the rotating lock latch bolt 110 to a first position to bolt the lock latch 140', and rotate the rotating lock latch bolt 110 to a second position to release the lock latch 140'.

Referring now to FIG. 6, a top view of the locking mechanism as shown in FIG. 5 while the locking mechanism is in a locked position is shown according to certain embodiments of the present invention. The sliding lock latch 140' may be positioned in the recess portion 116. When the sliding lock latch 140' is in the first position (the lock 100' is locked), the lock latch control mechanism 150 may rotate the rotating lock latch bolt 110 to the first position with certain angle, as shown in FIG. 6, to bolt sliding lock latch 140' to prevent the sliding lock latch 140' from moving away from the locked position.

Referring now to FIG. 7, a top view of the locking mechanism as shown in FIG. 5 while the locking mechanism is in an unlocked position is shown according to certain embodiments of the present invention. The sliding lock latch 140' may be positioned in the recess portion 116. When the rotating lock latch bolt 110 is rotated to the second position with certain angle, as shown in FIG. 7, the sliding lock latch 140' may be sliding freely up and down, and the lock latch control mechanism 150 may slide the sliding lock latch 140' to unlock the lock 100'.

In yet another aspect, the present invention relates to a method for operating a lock 100. In certain embodiments, the method may include: receiving a passcode for the lock 100 from a user at an electronic keypad, comparing the received passcode to one or more predetermined passcodes stored in the lock 100 to determine whether the user is an authorized user, terminating when the user is not an authorized user, or performing following operations when the user is an authorized user. When the lock 100 is in a locked position, the method may include: instructing a rotating lock latch bolt control mechanism 130 to rotate a rotating lock latch bolt 110 to an unlocked position to release a lock latch 140, displaying a message on a screen indicating that the lock 100 may be unlocked, and unlocking the lock 100 by moving the lock latch 140 to an unlocked position using a lock latch control mechanism 150. When the lock is in an unlocked position, the method may include locking the lock 100 by moving the lock latch 140 to a locked position using the lock latch control mechanism 150, instructing the rotating lock latch bolt control mechanism 130 to rotate the rotating lock latch bolt 110 to a locked position to bolt the lock latch 140, and displaying a message on the screen indicating that the lock 100 is locked.

In certain embodiments, the rotating lock latch bolt control mechanism 130 may include an electrical rotating lock latch bolt control mechanism, and a mechanical rotating lock latch bolt control mechanism.

In certain embodiments, the lock latch may include a rotating lock latch 140 as shown in FIG. 2, or a sliding lock latch 140' as shown in FIG. 5.

In certain embodiments, the lock latch control mechanism 150 may include a manual lock latch control mechanism, an electrical lock latch control mechanism, and a mechanical lock latch control mechanism.

Figure 8:
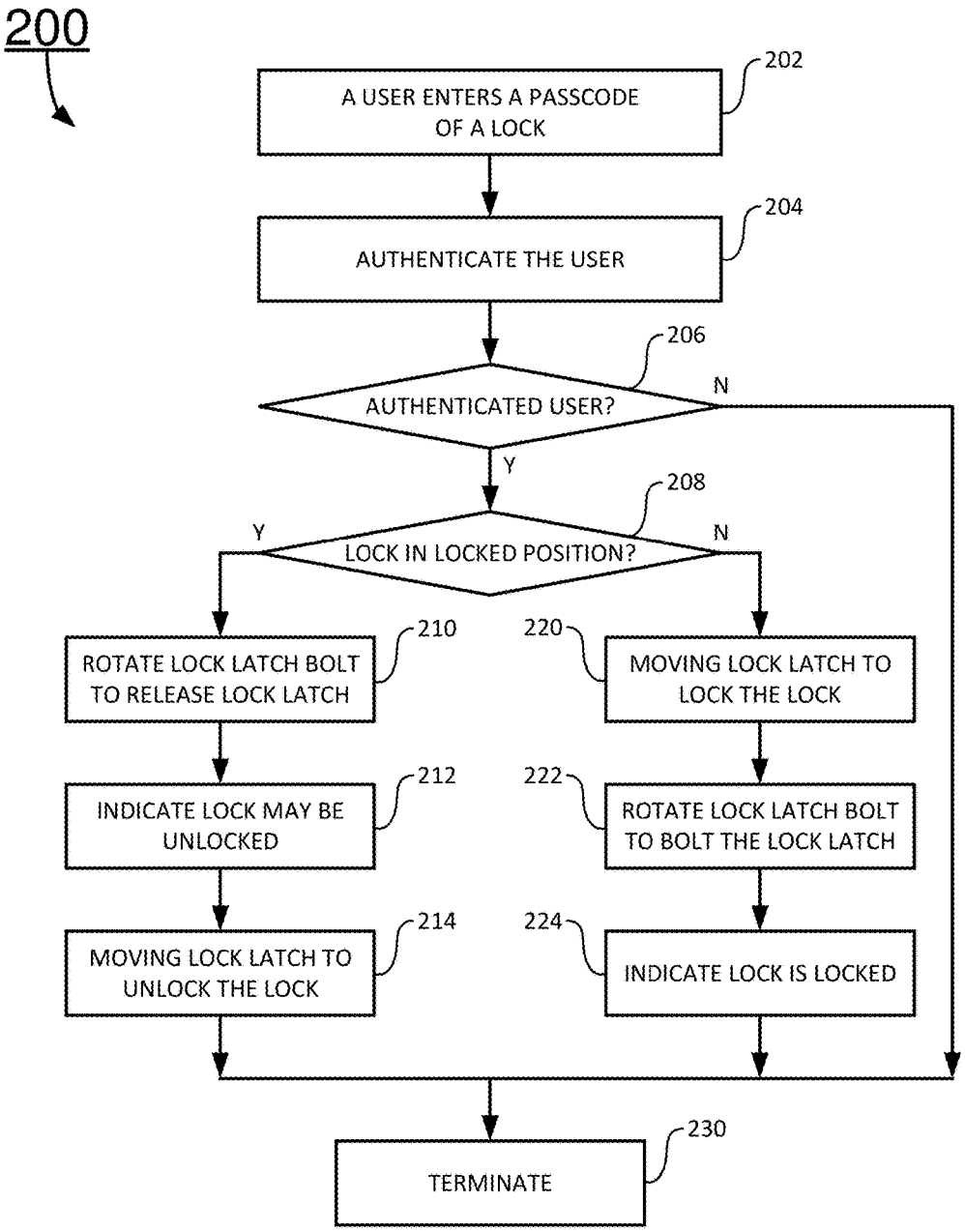
FIG. 8 shows a flow chart illustrating a method of operating a lock having a rotating lock latch bolt according to certain embodiments of the present invention.

Referring now to FIG. 8, a flow chart illustrating a method 200 of operating a safe lock having a rotating lock latch bolt is shown according to certain embodiments of the present invention.

At block 202, a user enters a passcode through a numerical keypad on a safe to open the safe.

At block 204, a control system of the safe receives the passcode entered by the user, and proceeds to authenticate the user. The control system of the safe compares the passcode entered with one or more predetermined and pre-stored passcodes in the safe to see if the user is an authorized user.

At query block 206, the control system of the safe determines whether the user is an authorized user based on the comparison at block 204. If the user is not an authorized user, the method 200 proceeds to terminate at block 230. If the user is not an authorized user, the method 200 proceeds to terminate at block 230. If the user is an authorized user, the method 200 proceeds to query block 208.

At query block 208, the control system of the safe determines whether the safe lock is locked or unlocked. If the safe lock is locked, the method 200 proceeds to block 210. If the safe lock is not locked, the method 200 proceeds to block 220.

At block 210, when the safe lock is locked, the control system of the safe may send instructions to a rotating lock latch bolt control mechanism 130 to rotate a rotating lock latch bolt 110 to an unlocked position.

At block 212, once the rotating lock latch bolt control mechanism 130 rotates the rotating lock latch bolt 110 to the unlocked position, the control system of the safe may display a message on a display screen of the safe to indicate the safe lock may be unlocked.

At block 214, the user may use a lock latch control mechanism 150 to unlock the safe lock. In certain embodiments, the lock latch control mechanism 150 may include a manual lock latch control mechanism, an electrical lock latch control mechanism, and a mechanical lock latch control mechanism. The manual lock latch control mechanism and the mechanical lock latch control mechanism may be used in deadbolt locks, or key operated locks. The electrical lock latch control mechanism and mechanical lock latch control mechanism may be used in safe locks, or home automation applications. In certain embodiments, the lock latch may include a rotating lock latch 140 as shown in FIG. 2, FIG. 3, and FIG. 4. The lock latch control mechanism 150 rotates the swinging lock latch 140 to its locked position as shown in FIG. 3. The lock latch may also include a sliding lock latch 140' as shown in FIG. 5, FIG. 6, and FIG. 7. The lock latch control mechanism 150 drives the sliding lock latch 140' vertically to its locked position as shown in FIG. 6. Once the safe lock is unlocked, the method 200 proceeds to be terminated at block 230.

At block 220, when the safe lock is unlocked, the user may use the lock latch control mechanism 150 to lock the safe lock. For the swinging lock latch, the lock latch control mechanism 150 rotates the swinging lock latch 140 to its unlocked position as shown in FIG. 4. For the sliding lock latch 140', the lock latch control mechanism 150 drives the sliding lock latch 140' vertically to its unlocked position as shown in FIG. 7.

At block 222, the control system of the safe may instruct the rotating lock latch bolt control mechanism 130 to rotate the rotating lock latch bolt 110 to bolt the lock latch 140.

At block 224, the control system of the safe then may display a message on the display screen of the safe to indicate the safe lock is locked. Once the safe lock is locked, the method 200 proceeds to be terminated at block 230.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A rotating lock latch bolt comprising:

a first cylindrical body having a lock latch bolt gear to receive rotating driving force from a rotating lock latch bolt control mechanism to rotate the rotating lock latch bolt; and a second cylindrical body positioned below the first cylindrical body, wherein one half of a middle portion of the second cylindrical body is removed to define a recess portion.

2. The rotating lock latch bolt according to claim 1, wherein the first cylindrical body and the second cylindrical body are connected co-axially and are rotatable along an axis of the first cylindrical body and the second cylindrical body.

3. The rotating lock latch bolt according to claim 2, wherein the rotating lock latch bolt control mechanism comprises a lock latch bolt control gear to drive the lock latch bolt gear to rotate the rotating lock latch bolt to a first position to bolt a lock latch, and rotate the rotating lock latch bolt to a second position to release the lock latch.

4. The rotating lock latch bolt according to claim 3, wherein the lock latch is positioned in the recess portion and the rotating lock latch bolt bolts the lock latch when the rotating lock latch bolt is in the first position, and releases the lock latch when the rotating lock latch bolt is in the second position.

5. A lock comprising:

a lock latch;

a lock latch control mechanism to drive the lock latch to a first position to lock the lock, and to a second position to unlock the lock;

a rotating lock latch bolt to bolt the lock latch to prevent the lock latch from moving when the lock latch is in the first position, wherein the rotating lock latch bolt comprises a first cylindrical body having a lock latch bolt gear to receive rotating driving force from a rotating lock latch bolt control mechanism to rotate the rotating lock latch bolt; and a second cylindrical body positioned below the first cylindrical body, wherein one half of a middle portion of the second cylindrical body is removed to define a recess portion; and a rotating lock latch bolt control mechanism to rotate the rotating lock latch bolt to bolt and release the lock latch.

6. The lock according to claim 5, wherein the lock latch control mechanism comprises:

a manual lock latch control mechanism;

an electrical lock latch control mechanism; and a mechanical lock latch control mechanism.

7. The lock according to claim 5, wherein the lock latch comprises:

a rotating lock latch; or a sliding lock latch.

8. The lock according to claim 5, wherein the rotating lock latch bolt control mechanism comprises:

an electrical rotating lock latch bolt control mechanism; and a mechanical rotating lock latch bolt control mechanism.

9. The lock according to claim 5, wherein the first cylindrical body and the second cylindrical body are connected co-axially and are rotatable along an axis of the first cylindrical body and the second cylindrical body.

10. The lock according to claim 9, wherein the rotating lock latch bolt control mechanism comprises a lock latch bolt control gear to drive the lock latch bolt gear to rotate the rotating lock latch bolt to a first position to bolt the lock latch, and rotate the rotating lock latch bolt to a second position to release the lock latch.

11. The lock according to claim 10, wherein the lock latch is disposed in the recess portion of the rotating lock latch bolt and the lock latch control mechanism is configured to control the movement of the lock latch.

12. The lock according to claim 10, wherein the lock is locked when the lock latch control mechanism drives the lock latch to the first position, and the rotating lock latch bolt control mechanism drives the rotating lock latch bolt to the first position.

13. The lock according to claim 10, wherein the lock is unlocked when the rotating lock latch bolt control mechanism drives the rotating lock latch bolt to the second position, and the lock latch control mechanism drives the lock latch to the second position.

14. A method for operating a lock comprising:

receiving a passcode for the lock from a user at an electronic keypad;

comparing the received passcode to one or more predetermined passcodes stored in the lock to determine whether the user is an authorized user;

performing following operations when the user is an authorized user, when the lock is in a locked position, instructing a rotating lock latch bolt control mechanism to rotate a rotating lock latch bolt to an unlocked position to release a lock latch, wherein the rotating lock latch bolt comprises a first cylindrical body having a lock latch bolt gear to receive rotating driving force from a rotating lock latch bolt control mechanism to rotate the rotating lock latch bolt, and a second cylindrical body positioned below the first cylindrical body, wherein one half of a middle portion of the second cylindrical body is removed to define a recess portion;

displaying a message on a screen indicating that the lock may be unlocked; and unlocking the lock by moving the lock latch to an unlocked position using a lock latch control mechanism; and when the lock is in an unlocked position, locking the lock by moving the lock latch to a locked position using the lock latch control mechanism;

instructing the rotating lock latch bolt control mechanism to rotate the rotating lock latch bolt to a locked position to bolt the lock latch; and displaying a message on the screen indicating that the lock is locked; and terminating when the user is not an authorized user.

15. The method according to claim 14, wherein the rotating lock latch bolt control mechanism comprises:

an electrical rotating lock latch bolt control mechanism; and a mechanical rotating lock latch bolt control mechanism.

16. The method according to claim 14, wherein the lock latch comprises:

a rotating lock latch; or a sliding lock latch.

17. The method according to claim 14, wherein the lock latch control mechanism comprises:

a manual lock latch control mechanism;

an electrical lock latch control mechanism; and a mechanical lock latch control mechanism.

* * * * *